US006252338B1

(12) United States Patent
Bergman et al.

(10) Patent No.: US 6,252,338 B1
(45) Date of Patent: Jun. 26, 2001

(54) REFLECTOR LAMP HAVING A REFLECTING SECTION WITH FACETED SURFACES

(75) Inventors: Rolf Bergman, Cleveland Heights; Frank Zalar, Willoughby Hills, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/082,922

(22) Filed: May 21, 1998

(51) Int. Cl.[7] ..... H01J 05/16; H01J 61/40; H01J 17/16; H01K 1/26; H01K 1/30

(52) U.S. Cl. ..... 313/113; 313/110; 313/634; 362/328; 362/297; 362/346; 362/348; 362/255

(58) Field of Search ..... 313/110, 113, 313/493, 634, 573; 362/217, 350, 340, 630, 347–48, 297, 346, 255, 328, 61, 302, 261, 304, 305, 307, 375, 308–310

(56) References Cited

U.S. PATENT DOCUMENTS 4,447,865 5/1984 VanHorn et al. .
4,494,176 1/1985 Sands et al. .
4,855,866 * 8/1989 Ejkelenboom et al. ..... 362/350
5,394,317 * 2/1995 Grenga et al. ..... 362/347
5,568,967 * 10/1996 Sikkens et al. ..... 362/328

* cited by examiner

*Primary Examiner*—Nimeshkumar D. Patel
*Assistant Examiner*—Mark Haynes
(74) *Attorney, Agent, or Firm*—Fay, Sharpe, Fagan, Minnich & McKee, LLP

(57) ABSTRACT

The invention is related to a reflector lamp comprising a parabolic primary reflecting section, a parabolic or spheric secondary reflecting section joined to the primary reflecting section, and an incandescent or discharge light source. The secondary reflecting section has faceted surfaces which longitudinally extend along the surface thereof so that most or substantially all the light reflected by the faceted surfaces avoids the light source and thus the light, which would be absorbed or scattered by the light source, is minimized or substantially eliminated.

16 Claims, 2 Drawing Sheets

REFLECTOR LAMP HAVING A REFLECTING SECTION WITH FACETED SURFACES

FIELD OF THE INVENTION

This invention relates to a reflector lamp having a reflecting section with faceted surfaces. More particularly, this invention relates to such a reflector lamp which provides improved luminous efficiency by virtue of such faceted surfaces.

BACKGROUND OF THE INVENTION

Known types of reflector lamps, such as floodlights, automotive headlamps and spotlights, comprise a concave reflector and a light source. The light source is recessed in the concave reflector which reflects frontwardly more than half of the total light output of the lamp. Well designed reflector lamps for display applications such as PAR 20, PAR 30 and PAR 38 lamp types, provide a visually uniform spot of light of a specified angular width. The luminous efficiency of this cone of light (beam) is an important parameter. Lamp makers are making great efforts in order to achieve even a slight further increase in luminous efficiency. The quantity of light in the beam can be increased by deeply recessing the light source in the reflector while, at the same time making the light source as small as possible, or for a fixed source size keeping the reflecting surface as far away from the source as possible.

As disclosed in U.S. Pat. No. 4,447,865 issued to Van Horn, Putz and Henderson, Jr. on May 8, 1984, an improved luminous efficiency and a beam pattern substantially circumferentially uniform about the lamp axis and a reasonably compact reflector lamp can be achieved by a concave reflector having a faceted parabolic front section, a spherical intermediate section and a parabolic rear section. Each section has substantially the same common focal point, and a filament light source is located transversally to the lamp axis at the substantially common focal point. The reflector sections are dimensioned so that substantially all light rays coming from the filament light source which are reflected by the spherical intermediate section become reflected by the faceted parabolic front section. The spherical intermediate section allows more of the light rays that are emanated by a long light source which otherwise would not initially strike the parabolic front section to be directed so as to become re-reflected by the parabolic front section. Additionally the light rays, reflected by the facets, include components thereof which are circumferential about the lamp axis and thereby provide a beam pattern which is substantially circumferentially uniform about the lamp axis.

Tungsten halogen filament tubes, mounted axially in the reflector, have generally replaced incandescent filaments as they provide a larger luminous efficiency and also provide whiter light. Filaments are long and have small diameters. When the halogen filament light tubes are axially positioned in the reflector, the facets make the diameter images appear to be larger and to approach the filament length image.

U.S. Pat. No. 4,494,176 of Sands, Marella and Fink, Jr. issued on Jan. 15, 1985 discloses a reflector lamp which may be of the parabolic aluminized reflector (PAR) type lamp. This prior art reflector lamp has a reduced amount of internal absorption and the internal reflective surfaces direct the light rays into the useful beam pattern more advantageously. Instead of the facets on the parabolic front section, the enhanced light output is achieved by subdividing the intermediate section disclosed in U.S. Pat. No. 4,447,865 into further intermediate sections.

This prior art type reflector lamp comprises a concave reflector and a finite light source positioned axially in the reflector. The geometric center of the light source is located approximately at the focal point of the concave reflector. The concave reflector comprises a parabolic reflective section and at least first and second additional parabolic sections. The first and the second additional parabolic sections are reflective and have a substantially common focal point confocal with the focal point of the concave reflector.

The prior art type reflector lamp comprises a further technical improvement. The subdivided intermediate sections, namely the first and second parabolic sections are aligned relative to the light source positioned approximately at the focal point of the concave reflector, i.e., at the focal point of the main parabolic reflective section. This alignment results in a further improved beam pattern. The first and the second additional sections are so aligned relative to the light source as to be effective to reflect light rays impinging on their surfaces onto the primary parabolic reflective section and thereby direct the light rays in an improved beam pattern. Nevertheless, in the case of elongated and axially positioned light sources, particularly halogen gas filament tubes, most of the light and infrared rays reflected by the intermediate section of the reflector go back to the light source itself which partly absorbs, partly scatters these rays. This phenomenon decreases the light output of the reflector lamp on one hand, and increases the temperature of the light source envelope on the other. The increased heat adversely influences the seal integrity and lumen maintenance of the halogen gas filament tube and brings about a premature darkening of the tube envelope.

Accordingly, an object of the present invention is to provide a reflector lamp, particularly a parabolic aluminized sealed halogen reflector lamp, with increased luminous efficiency. This object can be achieved by reducing or substantially eliminating the light absorbed or scattered by the light source.

SUMMARY OF THE INVENTION

In order to achieve these objects and advantages, our invention provides a reflector lamp comprising a substantially parabolic primary reflecting section, a substantially parabolic or substantially spheric secondary reflecting section joined to the primary reflecting section. The primary and secondary sections form a concave reflector with a substantially conic tertiary and a substantially planar, parabolic or spheric rear section. The reflector is provided with an incandescent halogen or discharge light source.

The secondary reflecting section has faceted surfaces longitudinally extending along the surface thereof so that a substantial portion of the light reflected thereby avoids the light source and the light absorbed or scattered by the light source is reduced.

In a preferred embodiment of the reflector lamp, the focal point of the secondary reflecting section is axially aligned relative to the focal point of the primary parabolic reflecting section toward the apex of the parabolic reflecting section so that the secondary reflecting section gives room for the ferrule seals needed to provide hermeticity.

In an alternate embodiment of the reflector lamp, the faceted surfaces of the secondary reflecting section are circumferentially alternately declined from and inclined to the tangent of the surface at an angle so that substantially all of the reflected light avoids the light source.

BRIEF DESCRIPTION OF THE DRAWINGS

Our invention will be described in greater detail by means of the embodiments illustrated in the accompanying drawings in which.

DESCRIPTION OF THE PREFERRED EMBODIMENTS

Figure 2:
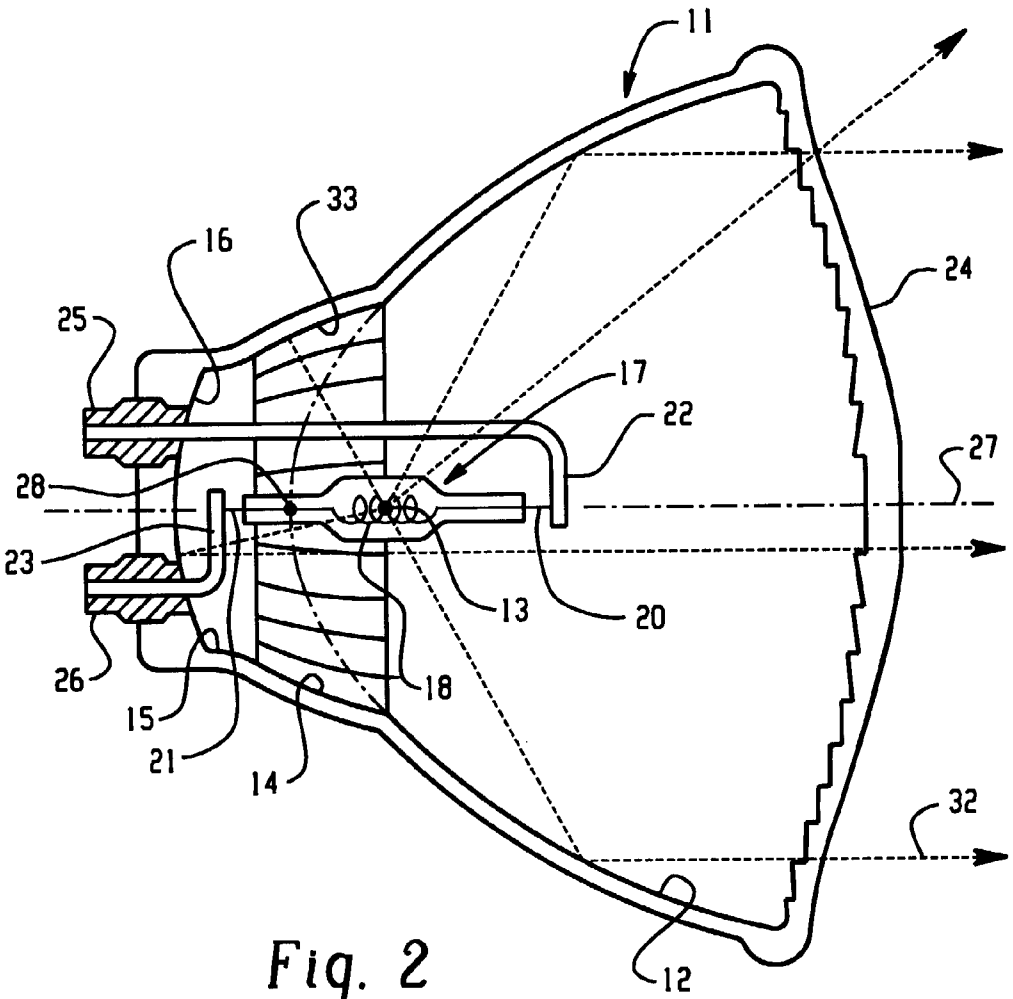
FIG. 2 is a cross section side view taken on the line 2—2 of FIG. 1.

A preferred embodiment of the invention, as shown in the drawings, comprises a reflector lamp having a concave reflector 11 shaped to have a primary reflecting section 12 which has a substantially parabolic contour with focal point 13, a faceted rotated secondary reflecting section 14 which has a substantially spheric contour with respect to the focal point 13, a substantially conic tertiary section 15, and a rear section 16 which may have a substantially planar, spheric or parabolic contour. The cross section of the rotated secondary reflecting section 14 in planes perpendicular to the principal optical axis thereof is substantially circular. The reflector 11 can be made of molded glass, the inner surfaces of the primary reflecting section 12, the secondary reflecting section 14, the tertiary section 15 and the rear section 16 being coated with reflective material, preferably with aluminum or silver.

A light source 17 centered approximately at the focal point 13, may be an incandescent, a halogen source or a discharge source. In the preferred embodiment of the invention, a halogen incandescent light source is shown.

As shown in FIG. 2, a filament 18 which is preferably made of tungsten, is provided with a pair of lead-out wires 20 and 21 of suitable material such as molybdenum. The filament 18 and the lead-out wires 20 and 21 are hermetically sealed in a halogen gas filled glass tube 19. The light source 17 is mounted on a pair of inner leads 22 and 23 of suitable material such as iron, nickel or nickel alloy. According to a preferred embodiment, the light source 17 is positioned coaxially with the central optical axis of the reflector 11 and centered approximately at the focal point 13 thereof, nevertheless it may be located elsewhere along the axis.

A lens means such as shaped lens or cover plate 24 may be placed or sealed over the front opening of the reflector, to protect the reflecting surface and keep it clean, and/or to modify the light pattern.

In the preferred embodiment of the present invention, the reflector 11 and the light source 17 together with the lens 24 are hermetically sealed to prevent metal component parts such as lead-out wires 20, 21 and inner leads 22, 23 from oxidation. For the sake of providing for hermeticity at the outlet of inner leads 22 and 23, ferrules 25 and 26 are mounted in the molded glass material of the reflector 11 at the rear section 16 thereof.

Although in the preferred embodiment the reflector 11 and the light source 17 are hermetically sealed, non-hermetically sealed embodiments such as adhesive sealed or glued reflector lamps remain within the scope of our invention. Similarly, although in the preferred embodiment the primary reflecting section 12 and the rotated secondary reflecting section 14 are substantially confocal (i.e., have the same focal point) the focal point of the secondary reflecting section 14 need not be located at substantially the same spatial position as the focal point 13 of the primary reflecting section. It is advantageous if the focal point of the secondary reflecting section 14 is aligned along the central optical axis relative to the focal point 13 of the primary reflecting section towards the apex 28 of the parabolic primary reflecting section. This alignment results in a further improved beam pattern as disclosed in the previously mentioned U.S. Pat. No. 4,447,865 and also provides more room for the axially mounted elongated halogen light source 17 and the component parts needed to provide hermeticity. These component parts are the lead-out wires 20 and 21, the inner leads 22 and 23, and the ferrules 25 and 26.

Although in the preferred embodiment the secondary reflecting section 14 is substantially spheric, this section may have a substantially parabolic shape.

Light rays which emanate from the light source 17 and which strike the surface of the secondary reflecting section 14, would be reflected, in the absence of the faceted surfaces, back to the light source 17 either to increase the heat of the lamp or to be scattered by the light source 17 and lost as useful light. With the addition of the faceted surfaces 33, a portion of the light rays will be reflected to strike the substantially parabolic primary reflection section 12 and be re-reflected thereby in a generally frontwardly direction and substantially parallel to the lamp axis 27 as indicated by the light ray path 32.

In the case of light sources such as halogen filament tubes, the secondary reflecting section 14 without the faceted surfaces 33 would tend to be less effective as the light output of the reflector lamp is reduced by the light rays absorbed and scattered by the light source 17. Furthermore, the heat generated by the absorbed and scattered infrared rays would limit the wattage of this sealed reflector lamp which has relatively poor heat dissipation.

Figure 1:
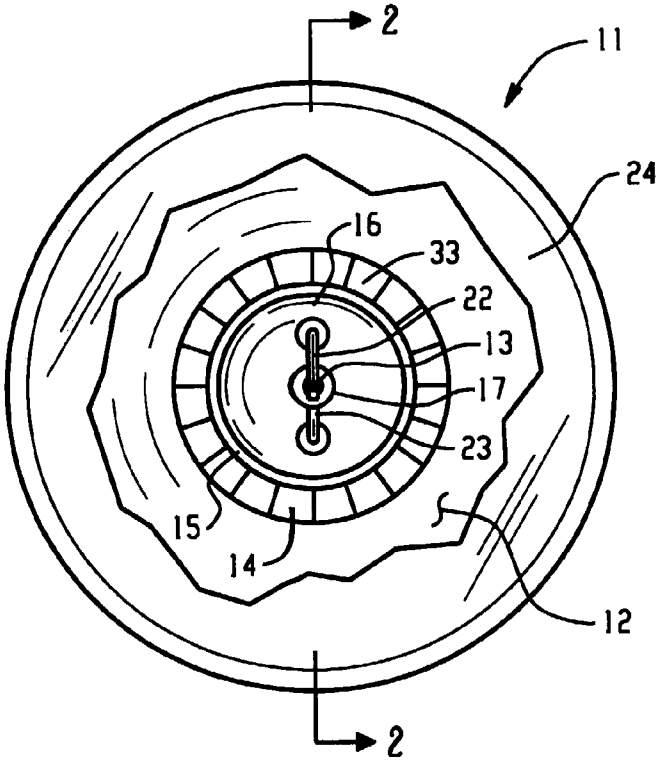
FIG. 1 is a front view of a reflector lamp in accordance with a preferred embodiment of the invention.
Figure 3:
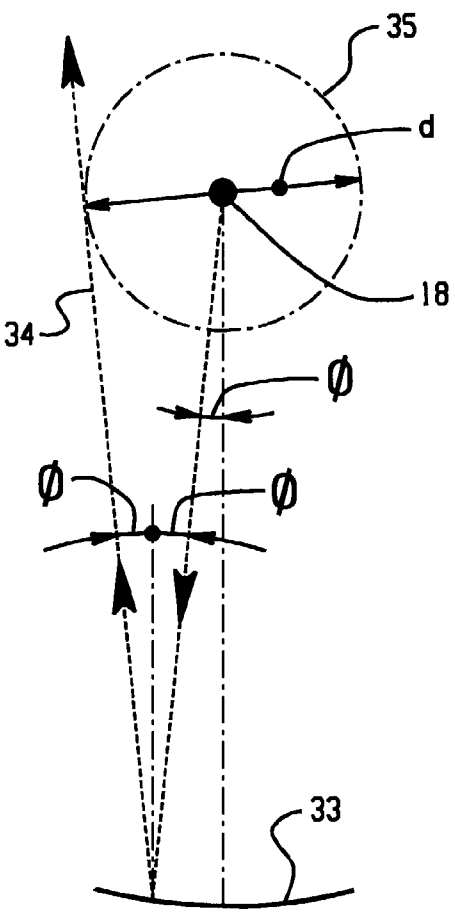
FIG. 3 is a fragmentary schematic cross section view taken on a plane perpendicular to the envelope of the light source in accordance with the preferred embodiment of the invention.

It has been recognized that inasmuch as the secondary reflecting section 14 has longitudinally extending faceted surfaces 33 that extend circumferentially about the axis (FIG. 1) along the surface, a portion of the light rays reflected by the secondary reflecting section 14 avoids the light source 17. As shown in FIG. 3, the light ray 34 emanated by the filament 18, practically at the focal point 13, of the light source 17 at an angle ø with respect to the norm of the faceted surface 33, will be reflected in a direction so as to avoid the envelope 35 of the light source. The angle ø can be calculated by the equation as follows:

$$\phi = 0.5\arcsin\frac{d}{D}$$

where d is the diameter of the envelope 35 and D is the diameter of the secondary reflecting section in the plane of reflection. In the case of a preferred form of glass halogen tube $$d=0.452'', \text{ and}$$

taking into account that $$D=1.84''$$

therefore $$\arcsin\frac{0.452''}{1.84''} = 14.2 \text{ degrees},$$

and consequently $$\phi = 7.1 \text{ degrees}.$$

The maximum number of the faceted surfaces is:

$$\frac{360 \text{ degrees}}{2\phi} = \frac{360 \text{ degrees}}{14.2 \text{ degrees}} = 25.$$

In the case of HIR (halogen infrared reflective) tube $$d = 0.3936'',$$

therefore $$\arcsin\frac{0.3936''}{1.84''} = 12.4 \text{ degrees},$$

and consequently $$\phi = 6.2 \text{ degrees}.$$

The maximum number of the faceted surfaces for HIR tube is 29.

The minimum number of the faceted surfaces is a function of the beam pattern desired from the reflector lamp. The estimated practical minimum number ranges from 12 to 16. Too many facets would be difficult to manufacture.

Nevertheless, light rays which strike the faceted surface 33 at an angle smaller than ø still do not avoid the envelope 35 of the light source.

Figure 4:
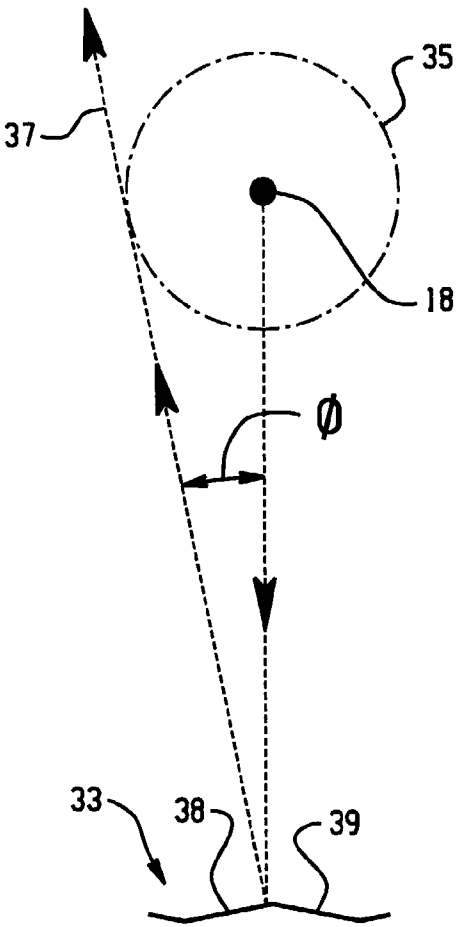
FIG. 4 is a fragmentary schematic cross section front view taken on a plane perpendicular to the envelope of the light source in accordance with an alternate embodiment of the present invention.

In accordance with an alternate embodiment of the present invention, the light absorbed or scattered by the light source 17 can be substantially eliminated. As shown in FIG. 4, the faceted surface 33 is subdivided into faceted surfaces 38 and 39 so that the secondary reflecting section 14 has faceted surfaces which are circumferentially alternately declined from and inclined to the tangent of the surface of the secondary reflecting section 14. Cross-sectionally a saw-tooth-form surface is created and the light ray 37, which in the absence of the saw-tooth-form faceted surface would strike the smoothly faceted surface 33 perpendicularly and which would be in the worst position to miss the light source 17, now avoids the light source 17. Faceted surfaces 38 and 39 are turned with the angle ø with respect to faceted surface 33 so that substantially all the light reflected by the secondary reflecting section 14 avoids the light source 17.

Figure 5:
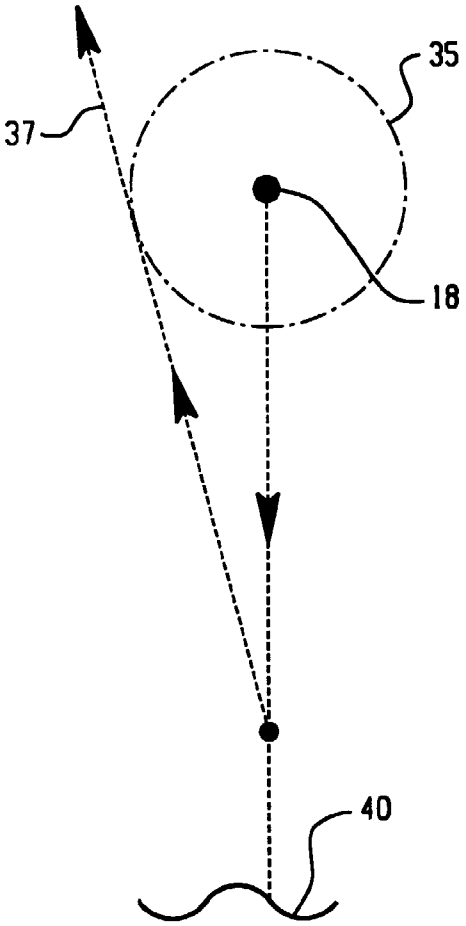
FIG. 5 is a fragmentary schematic cross section front view taken on a plane perpendicular to the envelope of the light source in accordance with yet another alternate embodiment of the present invention.

Although in the alternate embodiment the subdivided faceted surfaces 38 and 39 define a cross-sectionally saw-tooth-form surface, it remains still within the scope of our invention if the faceted surfaces form a substantially sinusoidal cross-section. This is illustrated in FIG. 5 where the faceted surface is a substantially sinusoidal cross-section 40. Again, light emanating from the light source, which was typically absorbed or scattered in prior arrangements, is now substantially eliminated by the alternating portions of the sinusoidal cross-section. A substantial portion of the light reflecting from the sinusoidal cross-section of the secondary reflecting section.

The embodiments shown are for the purpose of illustrating the invention and not intended to restrict the scope of protection. It is intended that the scope of protection be determined by the appended claims.

What we claim is:

1. A reflector lamp comprising:

a substantially parabolic primary reflecting section;

a secondary reflecting section having a contour distinct from said primary reflecting section joined to said primary reflecting section, said primary and secondary reflecting sections forming a substantially concave reflector, said reflector including:

a substantially conic tertiary section joined to said secondary reflecting section; and a rear section joined to said tertiary section the inner surfaces of said sections being coated with reflective material:

a light source contained in said primary and secondary sections; and said secondary reflecting section having faceted surfaces longitudinally extending along the surface thereof, and being positioned to redirect a substantial portion of the light reflected thereby to avoid said light source so that the light absorbed or scattered by said light source is reduced.

2. A lamp according to claim 1 wherein said primary and secondary reflecting sections are substantially confocal.

3. A lamp according to claim 1 wherein a focal point of said secondary reflecting section is axially aligned relative to a focal point of said primary reflecting section toward the apex thereof so that said secondary reflecting section gives room to component parts needed to provide hermeticity.

4. A lamp according to claim 1 wherein said primary and secondary reflecting sections and said light source are hermetically sealed.

5. A lamp according to claim 1 wherein said light source is a halogen filament light source.

6. A lamp according to claim 1 wherein said light source is a discharge light source.

7. A reflector lamp comprising:

a substantially parabolic primary reflecting section, a secondary reflecting section joined to said primary reflecting section, a light source contained in said primary and secondary sections; and said secondary reflecting section has faceted surfaces longitudinally extending along the surface thereof, and said faceted surfaces are circumferentially alternately declined from and inclined to the tangent of the surface of said reflecting section at an angle so that substantially all of the light reflected by said secondary reflecting section avoids said light source.

8. A lamp according to claim 7 wherein said faceted surfaces define cross-sectionally a substantially saw-tooth-form.

9. A lamp according to claim 7 wherein said faceted surfaces define cross-sectionally a substantially sinusoidal form.

10. A reflector lamp comprising:

a substantially parabolic unfaceted primary reflecting section;

a secondary reflecting section joined to said primary reflecting section, said primary and secondary reflecting sections forming a substantially concave reflector, said reflector including:

a substantially conic tertiary section joined to said secondary reflecting section; and a rear section joined to said tertiary section the inner surfaces of said sections being coated with reflective material;

a light source contained in said primary and secondary sections; and said secondary reflecting section having faceted surfaces longitudinally extending along the surface thereof, and being positioned to redirect a substantial portion of the light reflected thereby to avoid said light source so that the light absorbed or scattered by said light source is reduced.

11. A lamp according to claim 10 wherein said primary and secondary reflecting sections are substantially confocal.

12. A lamp according to claim 10 wherein a focal point of said secondary reflecting section is axially aligned relative to a focal point of said primary reflecting section toward an apex thereof so that said secondary reflecting section gives room to component parts needed to provide hermeticity.

13. A lamp according to claim 10 wherein said primary and secondary reflecting sections and said light source are hermetically sealed.

14. A lamp according to claim 10 wherein said light source is a halogen filament light source.

15. A lamp according to claim 10 wherein said light source is a discharge light source.

16. A reflector lamp comprising:

a substantially parabolic primary reflecting section;

a secondary reflecting section joined to said primary reflecting section;

a light source contained in said primary and secondary sections;

said secondary reflecting section has faceted surfaces longitudinally extending along the surface thereof, and being positioned to redirect a substantial portion of the light reflected thereby to avoid said light source so that the light absorbed or scattered by said light source is reduced;

said primary and secondary reflecting sections forming a substantially concave reflector; and said reflector having a substantially conic tertiary section joined to said secondary reflecting section and a rear section joined to said tertiary section, the inner surfaces of said sections being coated with reflective material.

* * * * *